US007327333B2

(12) United States Patent
Joo et al.

(10) Patent No.: US 7,327,333 B2
(45) Date of Patent: Feb. 5, 2008

(54) METHOD AND APPARATUS FOR REDUCING FLICKER WHEN DISPLAYING PICTURES ON A PLASMA DISPLAY PANEL

(75) Inventors: Mi-Young Joo, Suwon-si (KR); Im-Su Choi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 569 days.

(21) Appl. No.: 10/951,873

(22) Filed: Sep. 29, 2004

(65) Prior Publication Data

US 2005/0073616 A1 Apr. 7, 2005

(30) Foreign Application Priority Data

Oct. 1, 2003 (KR) ..... 10-2003-0068395

(51) Int. Cl.
*G09G 3/28* (2006.01)
*G09G 3/10* (2006.01)

(52) U.S. Cl. ..... 345/63; 345/61; 345/66; 345/68; 345/690; 315/169.1; 315/169.4; 348/687; 348/797

(58) Field of Classification Search ..... 345/60–63, 345/66–68, 208–210, 690–692; 313/306–308; 315/169.1–169.4; 348/687.797, 800, 867; 359/507, 618
See application file for complete search history.

(56) References Cited

U.S. PATENT DOCUMENTS 5,874,932 A * 2/1999 Nagaoka et al. ..... 345/60
6,097,358 A * 8/2000 Hirakawa et al. ..... 345/63
6,476,875 B2 11/2002 Correa et al.
6,714,250 B1 * 3/2004 Correa et al. ..... 348/447
7,139,007 B1 * 11/2006 Kawahara ..... 345/690
7,227,581 B2 * 6/2007 Correa et al. ..... 348/447
2002/0097201 A1 * 7/2002 Yamamoto et al. ..... 345/60

FOREIGN PATENT DOCUMENTS

| | | |
|---|---|---|
| EP | 0 982 707 | 3/2000 |
| JP | 09-218662 | 8/1997 |
| JP | 10-319903 | 12/1998 |
| JP | 2000-172225 | 6/2000 |
| JP | 2002-221934 | 8/2002 |
| JP | 2002-372947 | 12/2002 |
| KR | 2000-0016955 | 3/2000 |
| WO | WO 01/43112 A1 | 6/2001 |

* cited by examiner

*Primary Examiner*—Henry N Tran
(74) *Attorney, Agent, or Firm*—Robert E. Bushnell, Esq.

(57) ABSTRACT

A method and apparatus for reducing flicker when displaying pictures on a plasma display panel, based on an input phase alternation line (PAL) video signal of 50 Hz. Video signal data include successive first and second sub-field groups. When the number of sub-fields in the first sub-field group is more than that of sub-fields in the second sub-field group, the start or end points of the first and second sub-field groups are fixed, based on whether the video signal has a load ratio higher than a threshold value. When the number of sub-fields in the first sub-field group is less than that of sub-fields in the second sub-field group, the start or end points of the first and second sub-field groups are fixed, based on whether the video signal has a load ratio higher than a threshold value.

17 Claims, 13 Drawing Sheets

FIG.2(Background Art)

| Sub-field | SF1 | SF2 | SF3 | SF4 | SF5 | SF6 | SF7 | | SF1 | SF2 | SF3 | SF4 | SF5 | SF6 | SF7 | |
|---|---|---|---|---|---|---|---|---|---|---|---|---|---|---|---|---|
| Weight / Gray Scale | 1 | 4 | 8 | 16 | 24 | 32 | 40 | IDLE Period | 2 | 4 | 8 | 16 | 24 | 32 | 40 | IDLE Period |
| 0 | | | | | | | | | | | | | | | | |
| 1 | ◎ | | | | | | | | | | | | | | | |
| 2 | | | | | | | | | ◎ | | | | | | | |
| 3 | ◎ | | | | | | | | ◎ | | | | | | | |
| 4 | | | | | | | | | | ◎ | | | | | | |
| 5 | ◎ | | | | | | | | | ◎ | | | | | | |
| 6 | | ◎ | | | | | | | ◎ | | | | | | | |
| 7 | ◎ | ◎ | | | | | | | ◎ | | | | | | | |
| 8 | | ◎ | | | | | | | | ◎ | | | | | | |
| 9 | ◎ | ◎ | | | | | | | | ◎ | | | | | | |
| 10 | | ◎ | | | | | | | ◎ | ◎ | | | | | | |
| 11 | ◎ | ◎ | | | | | | | ◎ | ◎ | | | | | | |
| | G1 | | | | | | | | G2 | | | | | | | |

FIG.6

| Sub-field | SF1 | SF2 | SF3 | SF4 | SF5 | SF6 | SF7 | SF8 | | SF1 | SF2 | SF3 | SF4 | SF5 | SF6 | |
|---|---|---|---|---|---|---|---|---|---|---|---|---|---|---|---|---|
| Weight / Gray Scale | 1 | 2 | 4 | 8 | 16 | 24 | 32 | 40 | IDLE Period | 4 | 8 | 16 | 24 | 32 | 40 | IDLE Period |
| 0 | | | | | | | | | | | | | | | | |
| 1 | ◎ | | | | | | | | | | | | | | | |
| 2 | | ◎ | | | | | | | | | | | | | | |
| 3 | ◎ | ◎ | | | | | | | | | | | | | | |
| 4 | | | ◎ | | | | | | | | | | | | | |
| 5 | ◎ | | ◎ | | | | | | | | | | | | | |
| 6 | | ◎ | ◎ | | | | | | | | | | | | | |
| 7 | ◎ | ◎ | ◎ | | | | | | | | | | | | | |
| 8 | | | ◎ | | | | | | | ◎ | | | | | | |
| 9 | ◎ | | ◎ | | | | | | | ◎ | | | | | | |
| 10 | | ◎ | ◎ | | | | | | | ◎ | | | | | | |
| 11 | ◎ | ◎ | ◎ | | | | | | | ◎ | | | | | | |
| | G1 | | | | | | | G2 | | | | | | | | |

TIME G1G2 < TIME G2G1

TIME G1G2 = TIME G2G1

TIME G1G2 = TIME G2G1

TIME G1G2 > TIME G2G1

TIME G1G2 = TIME G2G1

TIME G1G2 = TIME G2G1

METHOD AND APPARATUS FOR REDUCING FLICKER WHEN DISPLAYING PICTURES ON A PLASMA DISPLAY PANEL

CLAIM OF PRIORITY

This application makes reference to and claims all benefits accruing under 35 U.S.C. §119 from an application for METHOD AND APPARATUS FOR DISPLAYING PICTURES ON PLASMA DISPLAY PANEL earlier filed in the Korean Intellectual Property Office on 1 Oct. 2003 and there duly assigned Ser. No. 2003-68395.

BACKGROUND OF THE INVENTION

1. Field of the Invention

The present invention relates to a method and apparatus for displaying pictures on a plasma display panel (PDP), and more particularly to a method and apparatus for reducing flicker when displaying pictures on a PDP, based on an input phase alternation line (PAL) video signal of 50 Hz.

2. Description of the Related Art

Recently, flat panel displays, such as liquid crystal displays (LCDs), field emission displays (FEDs) and PDPs, have been actively developed. The PDPs are advantageous over the other flat panel displays in regard to their high luminance, high luminous efficiency and wide viewing angle. Accordingly, the PDPs are being highlighted as a substitute for conventional cathode ray tubes (CRTs) for large-screen displays of more than 40 inches.

The PDPs are flat panel displays that use plasma generated by gas discharge to display characters or images. The PDPs include, according to their size, more than several tens to millions of pixels arranged in the form of a matrix. These PDPs are classified into a direct current (DC) type and an alternating current (AC) type according to patterns of waveforms of driving voltages applied thereto and discharge cell structures thereof.

Such PDPs must realize gradation display so that they function as color display devices. For the gradation display, a method has been used in which one field is divided into a plurality of sub-fields, and the sub-fields are controlled in a time-sharing manner.

Meanwhile, flickers may be generated in the gray scale expression in PDPs. Such flickers have close relation with the visual characteristics of human eyes. Generally, flickers may be more easily recognizable by human eyes on a larger screen or at a lower frequency. Where images of PAL video signals are displayed on a PDP, a large amount of flickers are generated because both the above-mentioned conditions are required.

Thus, when a PDP is driven at a vertical frequency of 50 Hz, using a general sub-field arrangement used in PDPs, for example, a lowest ascending-order arrangement or a lowest descending-order arrangement, a large amount of flickers may be generated.

It is impossible to adjust the screen size in association with the large-screen requirement, which is one of the above-mentioned two conditions causing generation of flickers. Accordingly, reduction of flickers may be achieved by adjusting the frequency, which is also associated with generation of flickers.

SUMMARY OF THE INVENTION

It is an aspect of the present invention to solve the problems incurred in the above-mentioned related art, and to provide a method and apparatus for displaying pictures on a PDP, which reduce generation of flickers by varying the idle period (vertical frame blanking period) present between successive sub-field groups in a frame in accordance with a load ratio of the frame upon driving the frame, using a sub-field arrangement for a PAL video signal of 50 Hz, and thus, causing light emission centers of the sub-field groups to have a periodicity.

In accordance with one aspect, the present invention provides a method for displaying pictures on a plasma display panel by dividing, into a plurality of sub-fields, each of frames respectively corresponding to pictures to be displayed on the plasma display panel, based on an input video signal, and combining luminance weights of the sub-fields to display gray scales, wherein the plurality of sub-fields are divided into a first sub-field group and a second sub-field group having sub-fields of a number less than the number of sub-fields in the first sub-field group, wherein in the method, a start point of the first sub-field group and an end point of the second sub-field group are fixed when the input video signal has a load ratio not higher than a predetermined threshold value, and sustain pulses of a number determined in accordance with the load ratio are applied, and an end point of the first sub-field group and the end point of the second sub-field group are fixed when the input video signal has a load ratio higher than the predetermined threshold value, and sustain pulses of the number determined in accordance with the load ratio are applied.

In accordance with another aspect, the present invention provides a method for displaying pictures on a plasma display panel by dividing, into a plurality of sub-fields, each of frames respectively corresponding to pictures to be displayed on the plasma display panel, based on an input video signal, and combining luminance weights of the sub-fields to display gray scales, wherein the plurality of sub-fields are divided into a first sub-field group and a second sub-field group having sub-fields of a number more than the number of sub-fields in the first sub-field group, wherein in the method, an end point of the first sub-field group and a start point of the second sub-field group are fixed when the input video signal has a load ratio not higher than a predetermined threshold value, and applying sustain pulses of a number determined in accordance with the load ratio, and the end point of the first sub-field group and an end point of the second sub-field group are fixed when the input video signal has a load ratio higher than the predetermined threshold value, and sustain pulses of the number determined in accordance with the load ratio are applied.

In accordance with another aspect, the present invention provides an apparatus for displaying pictures on a plasma display panel by dividing, into a plurality of sub-fields, each of frames respectively corresponding to pictures to be displayed on the plasma display panel, based on an input video signal, and combining luminance weights of the sub-fields to display a gray scale, comprising a video signal processor, a vertical frequency detector, a memory controller, an automatic power controller, a sub-field variation range determiner, and a sustain/scan pulse driving controller. The video signal processor digitizes the input video signal, thereby generating digital video data. The vertical frequency detector analyzes the digital video data output from the video signal processor, detects, based on the result of the analysis, whether the input video data is a phase alternation line (PAL) signal, and outputs the result of the determination as a data switch value, together with the digital video data. The memory controller receives the digital video data and data switch value output from the vertical frequency detector, generates sub-field data and address data corresponding to the received data switch value, and divides the sub-field data into successive first and second sub-field groups when the input video signal is a PAL video signal, and applies the generated sub-field data and address data to the plasma display panel. The automatic power controller detects a load ratio from the digital video data, calculates an automatic power control (APC) level, based on the detected load ratio, to derive the number of sustain discharge pulses corresponding to the calculated APC level, and outputs the calculated APC level and the derived number of sustain discharge pulses. The sub-field variation range determiner determines a variation range of each sub-field, based on the load ratio output from the automatic power controller, and determines points, to be fixed, from start and end points of the first and second sub-field groups, based on whether or not the load ratio is higher than a predetermined threshold value, thereby determining a start position of each sub-field. The sustain/scan pulse driving controller receives the number of sustain pulses, an address pulse width of each sub-field, the start position of each sub-field, and the data switch value from the sub-field variation range determiner, generates a sub-field arrangement based on the data switch value, generates a control signal based on the generated sub-field arrangement, and applies the control signal to the plasma display panel.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 2 is a table showing an example in which low gray scales are expressed using sub-field arrangements;

FIGS. 4*a* to 4*c* are diagrams showing sub-field positions and light emission center positions for various APC levels in a sub-field arrangement of a conventional PDP, wherein FIG. 4*a* shows the case associated with a minimum APC level, FIG. 4*b* shows the case associated with a maximum APC level, and FIG. 4*c* shows the case in which the period of a first sub-field group is longer than the period of a second sub-field group;

FIG. 6 is a table showing an example in which low gray scales are expressed using the sub-field arrangement according to the first embodiment of the present invention;

FIGS. 8*a* and 8*b* are diagrams showing sub-field positions and light emission center positions for various APC levels in the sub-field arrangement of FIG. 5, wherein FIG. 8*a* shows the case associated with a minimum APC level, and FIG. 8*b* shows the case associated with a maximum APC level;

FIGS. 9*a* to 9*c* are diagrams respectively illustrating a sub-field arrangement according to a second embodiment of the present invention, wherein FIG. 9*a* shows the case associated with a minimum APC level, FIG. 9*b* shows the case associated with an APC level increased from the minimum APC level, but not higher than a predetermined threshold value, and FIG. 9*c* shows the case associated with an APC level higher than the predetermined threshold value;

FIGS. 10*a* to 10*c* are diagrams showing sub-field positions and light emission center positions for various APC levels in the sub-field arrangement of FIGS. 9*a* to 9*c*, wherein FIG. 10*a* shows the case associated with a minimum APC level, FIG. 10*b* shows the case associated with an APC level increased from the minimum APC level, but not higher than the predetermined threshold value, and FIG. 10*c* shows the case associated with an APC level higher than the predetermined threshold value;

FIGS. 11*a* to 11*c* are diagrams respectively illustrating a sub-field arrangement according to a third embodiment of the present invention, wherein FIG. 11*a* shows the case associated with a minimum APC level, FIG. 11*b* shows the case associated with an APC level increased from the minimum APC level, but not higher than a predetermined threshold value, and FIG. 11*c* shows the case associated with an APC level higher than the predetermined threshold value;

FIGS. 12*a* to 12*c* are diagrams showing sub-field positions and light emission center positions for various APC levels in the sub-field arrangement of FIGS. 11*a* to 11*c*, wherein FIG. 12*a* shows the case associated with the minimum APC level, FIG. 12*b* shows the case associated with an APC level increased from the minimum APC level, but not higher than the predetermined threshold value, and FIG. 12*c* shows the case associated with an APC level higher than the predetermined threshold value.

DETAILED DESCRIPTION

Figure 1:
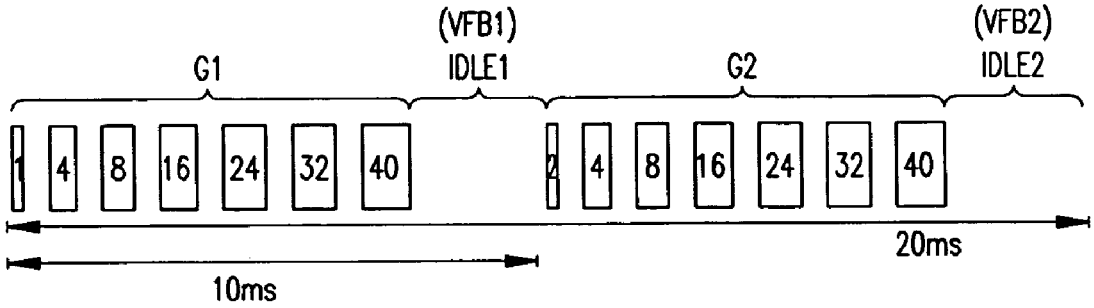
FIG.1(Prior Art)
FIG. 1 is a diagram illustrating a conventional sub-field arrangement.

A conventional method for reducing generation of flickers through frequency adjustment is disclosed in European Patent EP0982707 to Carlos Correa, et al., and titled METHOD AND APPARATUS FOR PROCESSING VIDEO PICTURES, IN PARTICULAR FOR LARGE AREA FLICKER EFFECT REDUCTION. In accordance with the method disclosed therein, as shown in FIG. 1, the sub-fields of one frame are divided into two groups G1 and G2, which are set to have the same sub-field arrangement in sub-fields thereof except for the least significant bit (LSB) sub-fields, or to have similar luminance weight distributions of sub-fields, in order to reduce large-area flickers generated when a PDP is driven, using a 50 Hz video signal. This method is very effective in reducing flickers, as compared to conventional sub-field arrangements such as a lowest ascending-order arrangement or lowest descending-order arrangement.

Referring to FIG. 1, the period of one frame is 20 ms in total, and the period of each sub-field group G1 or G2 is fixed to 10 ms. There are two idle periods IDLE1 and IDLE 2, one of which is present at the end of the frame period, that is, the end of the period of the second sub-field group G1, with the other being present between the first and second sub-field groups G1 and G2, that is, at the end of the first sub-field group G1. In other words, one vertical frame blanking period has been replaced by two vertical frame blanking periods VFB1, VFB2, one at the end of the frame period and the other between the two sub-field groups.

FIG. 2 is a table showing an example in which low gray scales are expressed using a conventional sub-field arrangement.

Where low gray scales of, for example, 0 to 11, are expressed using a sub-field arrangement, as shown in FIG. 2, the time interval between the LSB (least significant bit) and LSB+1 sub-fields is as long as several ms.

For instance, for a low gray scale of 3, the LSB sub-field SF1 of the first sub-field group G1 and the LSB sub-field SF1 of the second sub-field group G2 are driven (ON). In this case, the sub-field SF1 of the first sub-field group G1 is rendered to be the LSB sub-field of the frame, and the sub-field SF1 of the second sub-field group G2 is rendered to be the LSB+1 sub-field of the frame. Accordingly, the time interval between the LSB and LSB+1 sub-fields of the frame is 10 ms, and so, is very large.

Thus, where low gray scales are expressed using the sub-field arrangement disclosed in the above-mentioned publication while applying an error diffusion scheme, there is a problem in that severe pseudo contours (false contours) are generated at the boundary between adjacent gray scales when motion of a picture recognizable by human eyes is carried out, because the time interval between the LSB and LSB+1 sub-fields of the frame is as long as several ms, and the sustained emission period of light for the sub-fields associated with the large time interval is relatively short.

Figure 3:
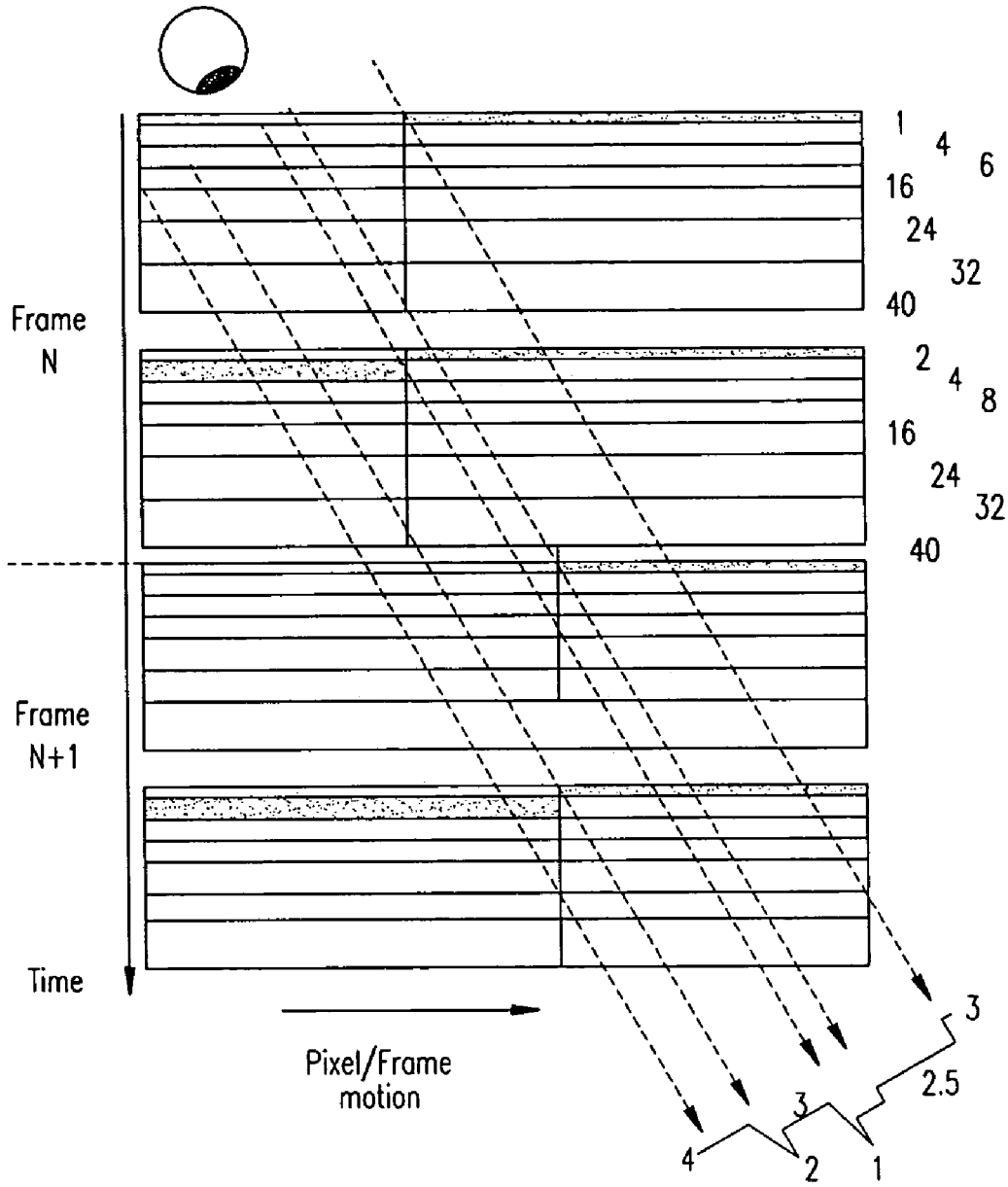
FIG.3(Background Art)
FIG. 3 is a conceptual view showing pseudo contours generated in accordance with motion of a picture for adjacent gray scales of 4 and 3 in the sub-field arrangement.

FIG. 3 is a conceptual view showing pseudo contours generated in accordance with motion of a picture for adjacent gray scales of 4 and 3. As shown in FIG. 3, pseudo contours are generated at five positions in total in accordance with motion of a picture for adjacent gray scales of 4 and 3. Respective differences between the highest one of the original gray scales, that is, the gray scale of 4, and gray scales distorted from the gray scale of 4 at respective pseudo contour generation positions are 2, 1, 3, 2, and 1.5. These differences represent respective intensities of the generated pseudo contours. Such distortion of gray scales is represented in the form of color distortion, and is recognizable in the form of a color distortion having a contour by human eyes.

U.S. Pat. No. 6,476,875 to Carlos Correa, et al. titled METHOD AND APPARATUS FOR PROCESSING VIDEO PICTURES ESPECIALLY FOR FALSE CONTOUR EFFECT COMPENSATION discusses plasma display panel technology wherein artefacts occur in video pictures. These artefacts are commonly described as "dynamic false contour effect", since they correspond to disturbances of gray levels and colors in the form of an apparition of colored edges in the picture when the observation point on the PDP screen moves.

Meanwhile, PDPs typically use an automatic power control (APC) scheme to control power consumption in accordance with the load ratio of a frame to be displayed (average signal level or load ratio) because they exhibit high power consumption due to the driving characteristics thereof. The APC scheme is a method to determine an APC level for input image data, depending on the load ratio of input image data, and to limit power consumption below a certain level while varying the number of sustain pulses depending on the determined APC level.

In accordance with such an APC scheme, the number of sustain pulses applied to each sub-field is varied, depending on the load ratio of the associated frame. That is, the total number of sustain pulses applied to each of the sub-field groups G1 and G2 in a frame varies in accordance with the load ratio of the frame. Thus, the number of sustain pulses applied to each sub-field is varied, depending on the load ratio of the frame, because each sub-field has the number of sustain pulses corresponding to the luminance weight of the sub-field.

Figure 4A:
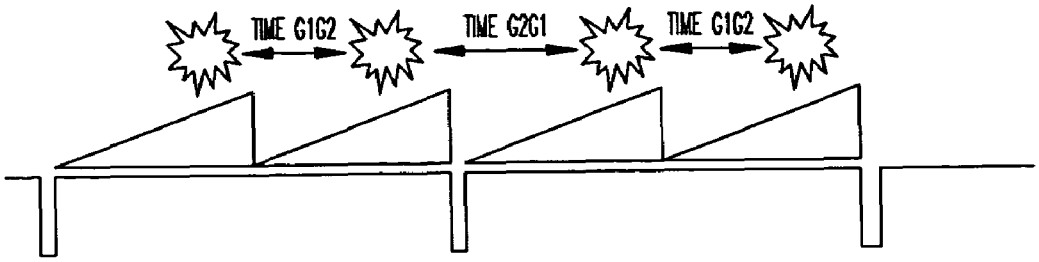
FIG.4a(background art)
Figure 4B:
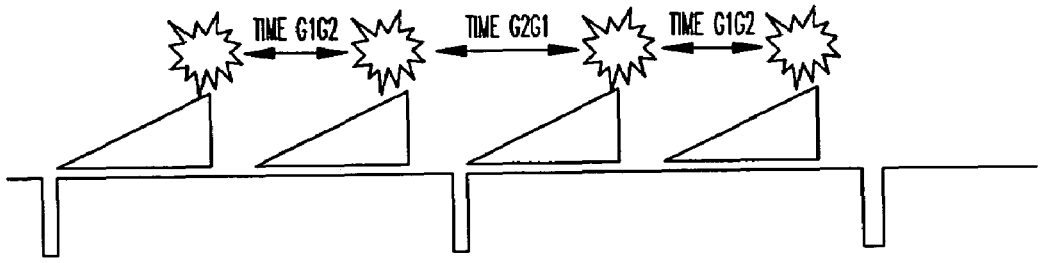
FIG.4b(background art)
Figure 4C:
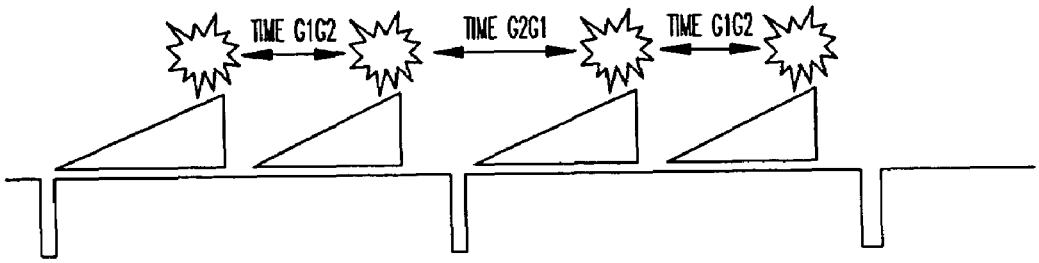
FIG.4c(background art)

FIGS. 4*a* to 4*c* are diagrams showing sub-field positions and light emission center positions for various APC levels in the sub-field arrangement of a PDP. FIG. 4*a* shows the case associated with a minimum APC level, and FIG. 4*b* shows the case associated with a maximum APC level.

As shown in FIGS. 4*a* and 4*b*, in either case of the minimum APC level or the maximum APC level, the time intervals of light emission center positions in all sub-field groups G1 and G2 in successive frames, that is, the time interval TIME G1G2 and the time interval TIME G2G1, are identical. Accordingly, the light emission center positions of the first and second sub-field groups G1 and G2 have a periodicity for various gray scale ranges. Therefore, the sub-field arrangement of the PDP generates a reduced amount of flickers.

However, when the period of the first sub-field group G1 is longer than the period of the second sub-field group G2, upon expressing certain gray scales irrespective of APC level, as shown in FIG. 4*c*, the LSB sub-fields of the first and second sub-field groups G1 and G2, which are driven (ON), are varied in position. In this case, the time interval TIME G1G2 between the light emission center positions of the first and second sub-field groups G1 and G2 in one frame is shorter than the time interval TIME G2G1 between the light emission center position of the second sub-field group G2 in the frame and the light emission center position of the first sub-field group G1 in the next frame. As a result, the light emission centers of the sub-field groups G1 and G2 in successive frames lose periodicity, thereby causing generation of flickers.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

In the drawings, illustrations of elements having no relation with the present invention are omitted in order to prevent the subject matter of the present invention from being unclear. In the specification, the same or similar elements are denoted by the same reference numerals even though they are depicted in different drawings.

A method and apparatus for displaying pictures on a PDP in accordance with an exemplary embodiment of the present invention will be described in detail with reference to the annexed drawings.

Figure 5:
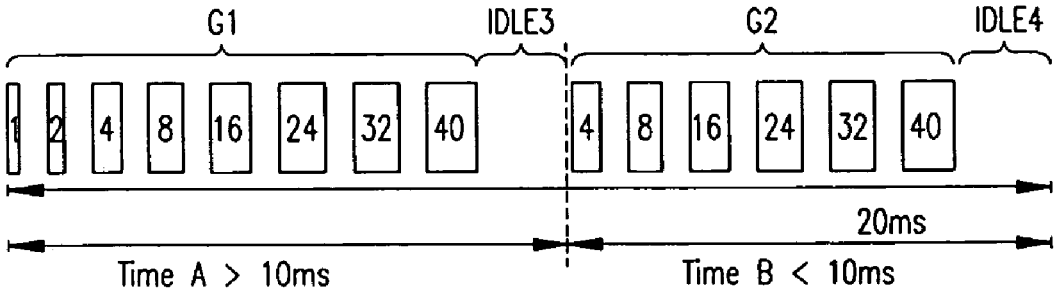
FIG. 5 is a diagram illustrating a sub-field arrangement according to a first embodiment of the present invention.

FIG. 5 is a diagram illustrating a sub-field arrangement according to a first embodiment of the present invention.

As shown in FIG. 5, one frame is composed of two individual sub-field groups G1 and G2 in accordance with the first embodiment of the present invention. Also, the frame has two idle periods IDLE3 and IDLE4 positioned at respective ends of the sub-field groups G1 and G2.

The first sub-field group G1 consists of 8 sub-fields. Respective luminance weights of the sub-fields in the first sub-field group G1 are set to 1, 2, 4, 8, 16, 24, 32, and 40, starting from a least significant bit (LSB) one of the sub-fields. However, setting of luminance weights in the first sub-field group G1 may be appropriately varied by those skilled in the art.

The second sub-field group G2 consists of 6 sub-fields. Respective luminance weights of the sub-fields in the second sub-field group G2 are set to 4, 8, 16, 24, 32, and 40, starting from an LSB one of the sub-fields. However, setting of luminance weights in the second sub-field group G2 may be appropriately varied by those skilled in the art.

In this case, the sub-field arrangement of the first sub-field group G1 corresponds to an arrangement in which LSB and LSB+1 sub-fields respectively having luminance weights of 1 and are added to the sub-field arrangement of the second sub-field group G2.

In this case, the first sub-field group G1 starts from a start position of the frame, that is, 0 ms. The total period Time A of the first sub-field group G1 including an idle period IDLE3, for which no APC (automatic power control) is carried out because the load ratio of the frame is minimal, is set to be longer than 10 ms. Accordingly, the total period Time B of the second sub-field group G2 including an idle period IDLE4 is set to be shorter than 10 ms. That is, Time A>Time B.

FIG. 6 is a table showing an example in which low gray scales are expressed using the sub-field arrangement according to the first embodiment of the present invention.

Where low gray scales of, for example, 0 to 11, are expressed using the sub-field arrangement according to the first embodiment of the present invention, as shown in FIG. 6, the time interval between the sub-fields respectively having luminance weights of 1 and 2, that is, the LSB and LSB+1 sub-fields of the frame, is negligibly short.

For example, for a low gray scale of 3, the LSB and LSB+1 sub-fields SF1 and SF2 of the first sub-field group G1 are driven (ON). In this case, there is a small time interval between the driven sub-fields SF1 and SF2 because both the driven sub-fields SF1 and SF2 are present in the first sub-field group G1.

Where the LSB and LSB+L sub-fields of the frame are arranged at the start point of the first sub-field group G1 such that they are adjacent to each other, the time interval between the LSB and LSB+1 sub-fields of the frame is very short. Accordingly, it is possible to greatly reduce pseudo contours generated at the boundary of adjacent gray scales when motion of a picture recognizable by human eyes is carried out.

Figure 7:
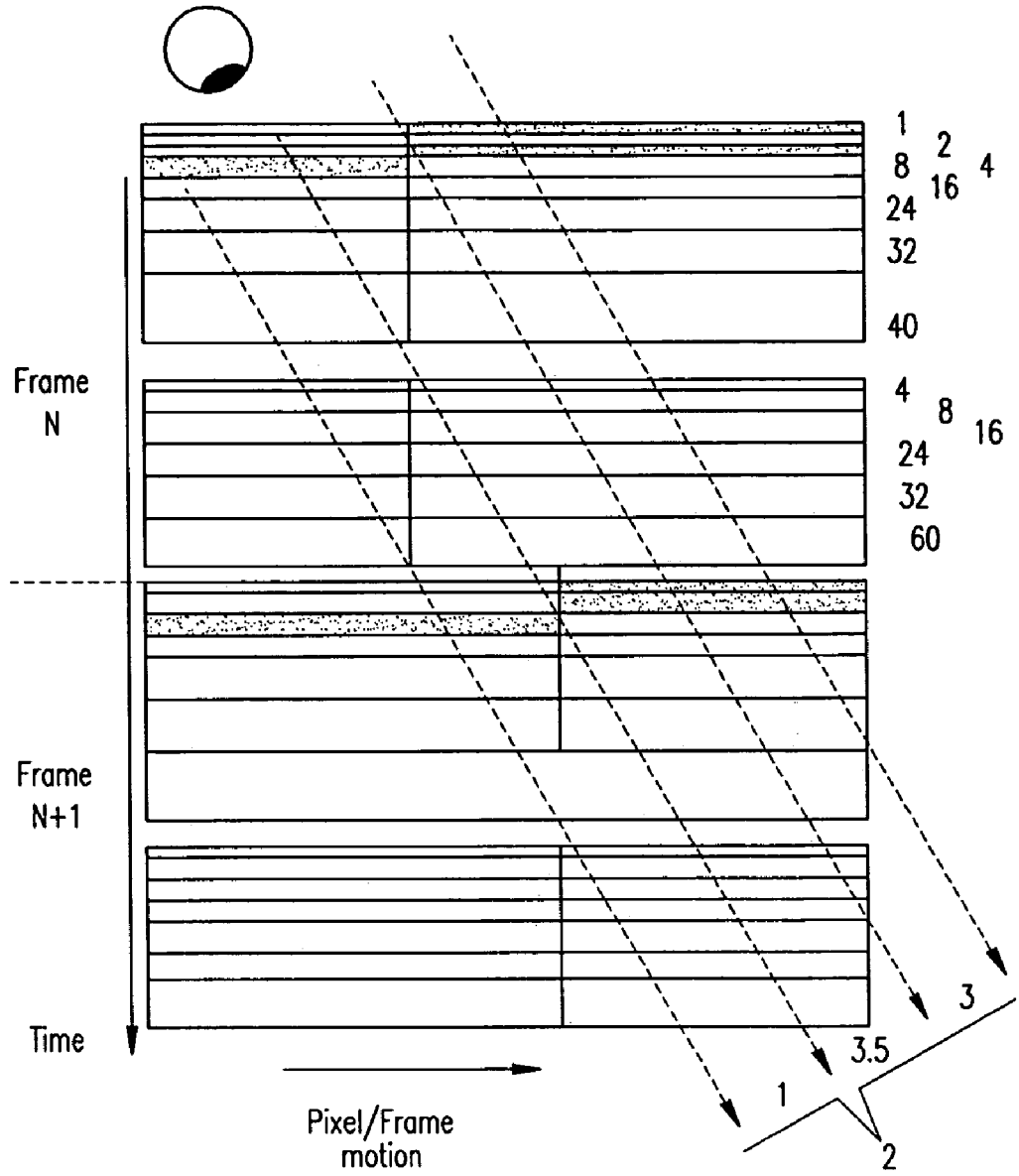
FIG. 7 is a concept view showing pseudo contours generated in accordance with motion of a picture for adjacent gray scales of 4 and 3 in the sub-field arrangement according to the first embodiment of the present invention.

FIG. 7 is a concept view showing pseudo contours generated in accordance with motion of a picture for adjacent gray scales of 4 and 3 in the sub-field arrangement according to the first embodiment of the present invention.

As shown in FIG. 7, pseudo contours are generated at two positions in total in accordance with motion of a picture for adjacent gray scales of 4 and 3 in the sub-field arrangement according to the first embodiment of the present invention. Respective differences between the highest one of the original gray scales, that is, the gray scale of 4, and gray scales distorted from the gray scale of 4 at respective pseudo contour generation positions are 2 and 0.5. Accordingly, it can be seen that the sub-field arrangement according to the first embodiment of the present invention exhibits a reduced number of pseudo contour generation positions by 3, as compared to a conventional sub-field arrangement and a reduced difference between the original gray scale and the distorted gray scale corresponding to ¼ of that of the conventional sub-field arrangement.

Thus, the sub-field arrangement according to the first embodiment of the present invention exhibits a great reduction in generation of pseudo contours, as compared to the conventional sub-field arrangement.

However, the sub-field arrangement according to the first embodiment of the present invention may involve generation of flickers in that there is no periodicity of light emission center positions because the total period of the first sub-field group G1 is longer than the total period of the second sub-field group G2.

Hereinafter, this problem will be described in detail, and a method for solving this problem will also be described.

First, sub-field positions and light emission center positions in the sub-field arrangement according to the first embodiment of the present invention established when APC is carried out will be described.

Figure 8A:
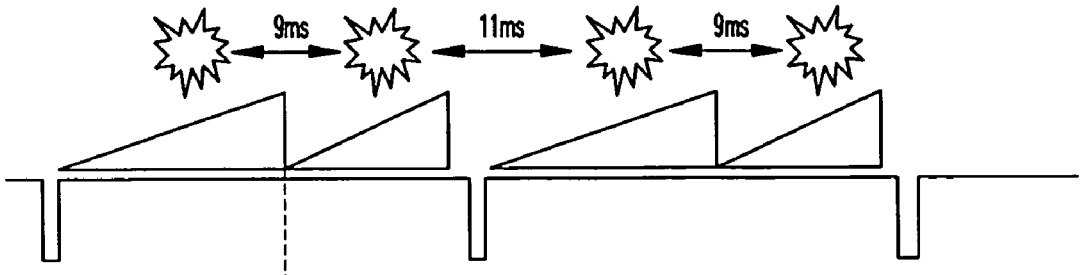
Figure 8B:
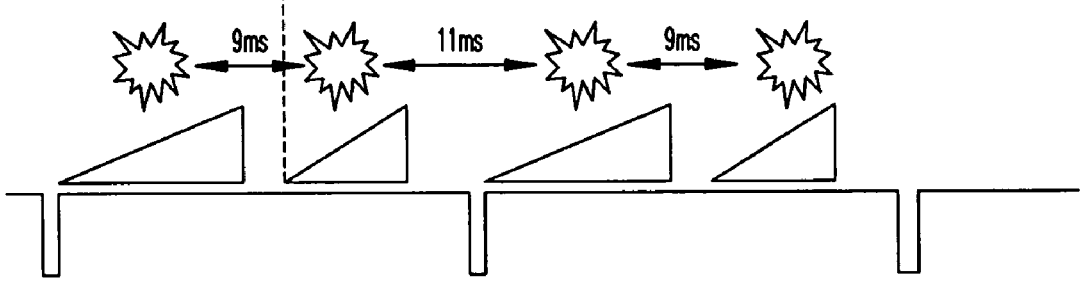

FIGS. 8*a* and 8*b* are diagrams showing sub-field positions and light emission center positions for various APC (automatic power control) levels in the sub-field arrangement of FIG. 5. FIG. 8*a* shows the case associated with a minimum APC level, and FIG. 8*b* shows the case associated with a maximum APC level.

As shown in FIG. 8*a*, in the case of the minimum APC level, the time interval between the light emission center positions of the sub-field groups G1 and G2 in one frame may be, for example, 9 ms, and the time interval between the light emission center position of the sub-field group G2 in the frame and the light emission center position of the sub-field group G1 in the next frame may be, for example, 11 ms, so as to be slightly longer than the time interval of 9 ms.

Meanwhile, in the case other than the case of the minimum APC level, for example, when APC (automatic power control) is carried out, or in the case of the maximum APC level as shown in FIG. 8*b*, the time interval between the light emission center positions of the sub-field groups G1 and G2 in one frame is the same as the case of the minimum APC level shown in FIG. 8*a*, and the time interval between the light emission center position of the sub-field group G2 in the frame and the light emission center position of the sub-field group G1 in the next frame is also the same as the case of the minimum APC level shown in FIG. 8*a*.

Thus, the period of each sub-field in each of the first and second sub-field groups G1 and G2 is reduced, and the idle periods IDLE3 and IDLE4 increase when APC is carried out or in the case of the maximum APC level, as shown in FIG. 8*b*, as compared to the case of the minimum APC level shown in FIG. 8*a*. However, the start point of the second sub-field group G2 is constant. For this reason, the time interval between the light emission center positions of the first and second sub-field groups G1 and G2 in one frame increases, whereas the time interval between the light emission center position of the sub-field group G2 in the frame and the light emission center position of the sub-field group G1 in the next frame is reduced. As a result, the time interval between the light emission center positions of successive sub-field groups is the same as the case of the minimum APC level.

Since the start position of each sub-field is fixed irrespective of whether or not APC is carried out, that is, the start point of the second sub-field group G2 is fixed irrespective of the APC level, respective light emission centers of the sub-field groups G1 and G2 are non-periodically exhibited. As a result, flickers may be generated.

Hereinafter, a sub-field arrangement according to a second embodiment of the present invention to solve the above-described problems will be described in detail with reference to FIGS. 9*a* to 9*c* and FIGS. 10*a* to 10*c*.

Figure 9A:
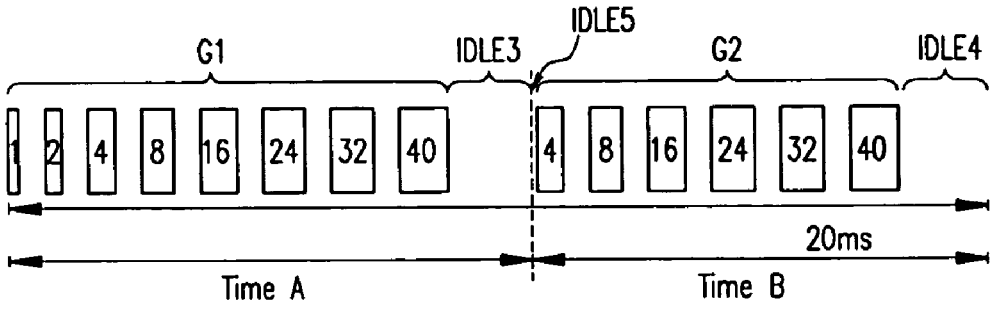
Figure 9B:
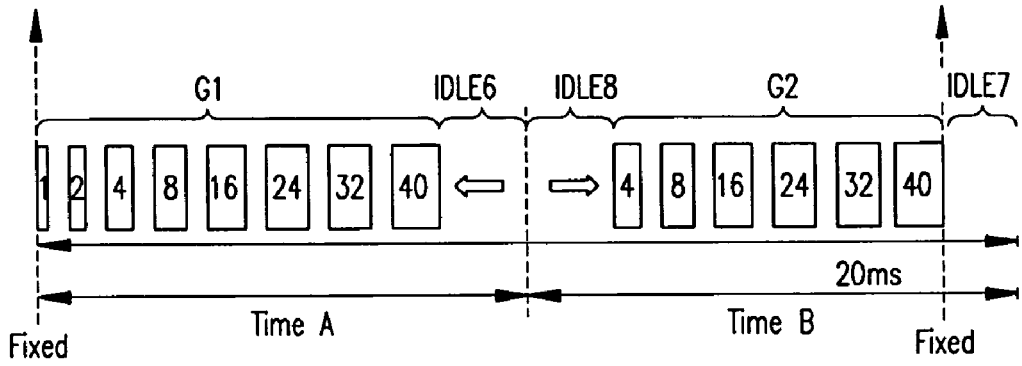
Figure 9C:
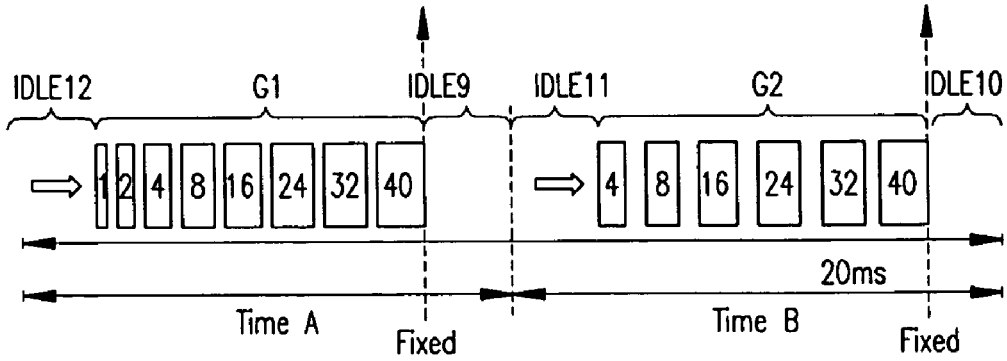

FIGS. 9*a* to 9*c* are diagrams respectively illustrating the sub-field arrangement according to the second embodiment of the present invention. FIG. 9*a* shows the case associated with a minimum APC level, FIG. 9*b* shows the case associated with an APC level increased from the minimum APC level, but not higher than a predetermined threshold value, and FIG. 9*c* shows the case associated with an APC level higher than the predetermined threshold value.

In the case of the minimum APC level, as shown in FIG. 9*a*, the sub-field arrangement according to the second embodiment of the present invention is the same as the sub-field arrangement according to the first embodiment of the present invention (FIG. 5). Although there is an idle period IDLE5 at the start point of the second sub-field group G2 in the sub-field arrangement of FIG. 9*a*, this idle period IDLE5 is negligible in the case of the minimum APC level because the load ratio in this case is the minimum (that is, display is carried out using a maximum number of sustaining discharge pulses). However, the period Time B of the second sub-field group G2 exactly includes the idle period IDLE5 as well as the idle period IDLE4, as shown in FIG. 9*a*.

When the APC level gradually increases from the minimum APC level to a certain level not higher than the predetermined threshold value, the idle period IDLE6 positioned at the end point of the first sub-field group G1 gradually increases, as shown in FIG. 9*b*. In this case, the idle period IDLE8 positioned at the start point of the second sub-field group G2 gradually increases. This can be implemented by fixing the start point of the first sub-field group G1 while fixing the end position of the second sub-field group G2. That is, when a gradual increase in APC level occurs, the idle period IDLE6 positioned at the end point of the first sub-field group G1 and the idle period IDLE8 positioned at the start point of the second sub-field group G2 gradually increase because respective periods of the first and second sub-field groups G1 and G2 are gradually reduced. In this case, the idle period IDLE7 positioned at the end point of the second sub-field group G2 is fixed to be the same as or slightly longer than the idle period IDLE4 in the case in which no APC is carried out. The increase in the idle periods IDLE6 and IDLE8 is carried out while including an increase in the idle period IDLE7. Accordingly, the idle periods IDLE6 and IDLE8 are longer than the idle periods IDLE3 and IDLE5 in the case in which no APC is carried out.

When the idle periods IDLE6 and IDLE8 increase in accordance with an increase in APC level, as shown in FIG. 9*b*, the time interval between the light emission center positions of the first and second sub-field groups G1 and G2 in one frame increases, and the time interval between the light emission center position of the second sub-field group G2 in the frame and the light emission center position of the first sub-field group G1 in the next frame is reduced. As a result, the time intervals of the light emission center positions of successive sub-field groups G1 and G2 in successive frames are gradually approximated to be the same.

The APC level reaches the predetermined threshold APC level when the time intervals of the light emission center positions of successive sub-field groups G1 and G2 in successive frames are rendered to be the same in accordance with the increase in APC level as shown in FIG. 9*b*. The threshold APC level may be experimentally determined.

When the APC level increases over the predetermined threshold value, the end point of the first sub-field group G1 is fixed, as shown in FIG. 9*c*. In this case, the idle period IDLE12 positioned at the start point of the first sub-field group G1 is gradually increased in accordance with the increase in APC level.

For the second sub-field group G2, the end point thereof is fixed, as shown in FIG. 9*b*. Also, the idle period IDLE11 positioned at the start point of the second sub-field group G2 is gradually increased in accordance with the increase in APC level. In this case, the idle period IDLE9 is the same as the idle period IDLE6 set when the APC level reaches the predetermined threshold value. Through this method, the time interval between the light emission center positions of successive sub-field groups G1 and G2 in successive frames is constant, even when the APC level increases over the predetermined threshold value. That is, when the APC level increases over the predetermined threshold value, the time interval between the light emission center positions of successive sub-field groups G1 and G2 in successive frames can be constant by fixing the end point of the first sub-field group G1 and the end point of the second sub-field group G2.

Figure 10A:
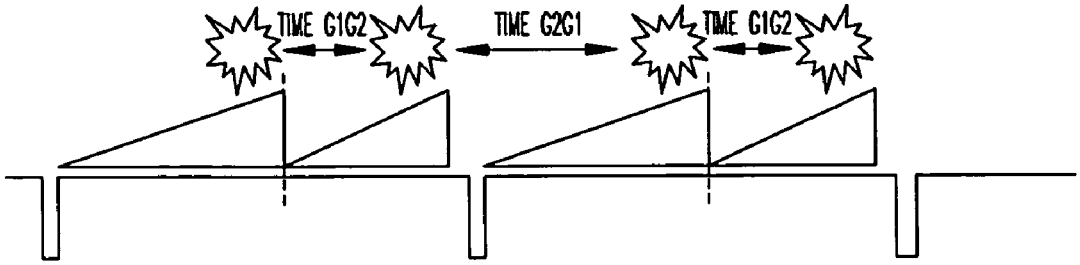
Figure 10B:
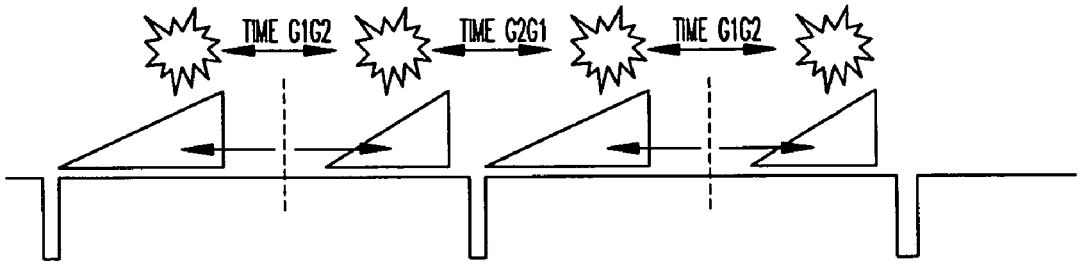
Figure 10C:
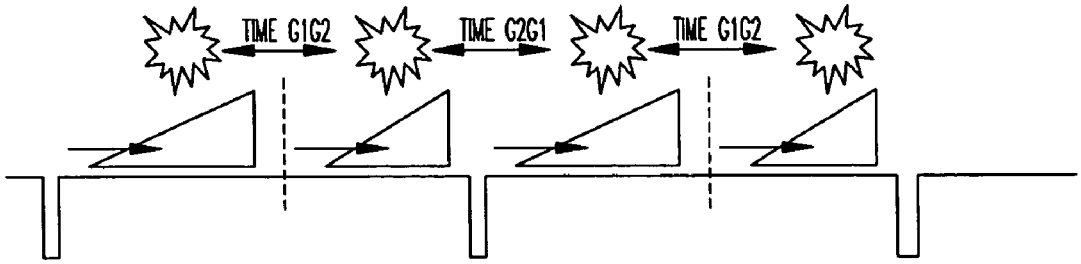

FIGS. 10*a* to 10*c* are diagrams showing sub-field positions and light emission center positions for various APC levels in the sub-field arrangement of FIGS. 9*a* to 9*c*. FIG. 10*a* shows the case associated with a minimum APC level, FIG. 10*b* shows the case associated with an APC level increased from the minimum APC level, but not higher than the predetermined threshold value, and FIG. 10*c* shows the case associated with an APC level higher than the predetermined threshold value.

As shown in FIGS. 10*a* to 10*c*, in either case in which the APC level increases from the minimum APC level to a level not higher than the predetermined threshold value or a level higher than the predetermined threshold value, respective periods of the first and second sub-field groups G1 and G2 are reduced, and respective idle periods increase, as compared to the case of the minimum APC level.

When the APC level increases to a certain level not higher than the predetermined threshold value, the start point of the second sub-field group G2 varies to be spaced apart from the first sub-field group G2 by an increased interval, as compared to the case of a lower APC level (that is, the case of FIG. 10*a*), as shown in FIG. 10*b*. Accordingly, the time interval TIME G1G2 between the light emission center positions of the sub-field groups G1 and G2 in one frame increases, as compared to the case of the lower APC level. On the other hand, the time interval TIME G2G1 between the light emission center position of the sub-field group G2 in the frame and the light emission center position of the sub-field group G1 in the next frame is reduced, as compared to the case of the lower APC level. As a result, the time intervals TIME G1G2 and TIME G2G1 of successive sub-field groups in successive frames are gradually varied to be the same.

When the APC level reaches the predetermined threshold value, the time intervals TIME G1G2 and TIME G2G1 of successive sub-field groups in successive frames are rendered to be the same.

When the APC level increases over the predetermined threshold value, the start point of the first sub-field group G1 is further spaced apart from a sync pulse associated therewith in accordance with the increase in APC level, as shown in FIG. 10*c* (that is, the case of the sub-field arrangement shown in FIG. 9*c*). That is, the idle period IDLE12 increases. In this case, the idle period IDLE9 is maintained to be the same as the case in which the APC level corresponds to the predetermined threshold value. Through this method, the light emission center position of each sub-field group coincides with the point at which the APC level corresponds to the predetermined threshold value, in spite of the APC level increase. Accordingly, even when the APC level increases over the predetermined threshold value, the time intervals TIME G1G2 and TIME G2G1 of the light emission center positions of successive sub-field groups G1 and G2 in successive frames are maintained to be the same.

Although it has been described that, where the number of sub-fields in the first sub-field group is more than the number of sub-fields in the second sub-field group, reduction of pseudo contours and flickers can be achieved, using the methods according to the first and second embodiments of the present invention, these methods may also be applied to the case in which the number of sub-fields in the first sub-field group is less than the number of sub-fields in the second sub-field group. This will be described with reference to FIGS. 11*a* to 11*c* and FIGS. 12*a* to 12*c*.

Figure 11A:
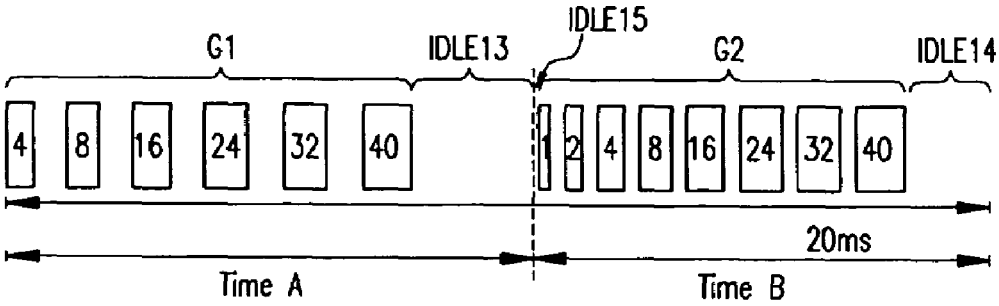
Figure 11B:
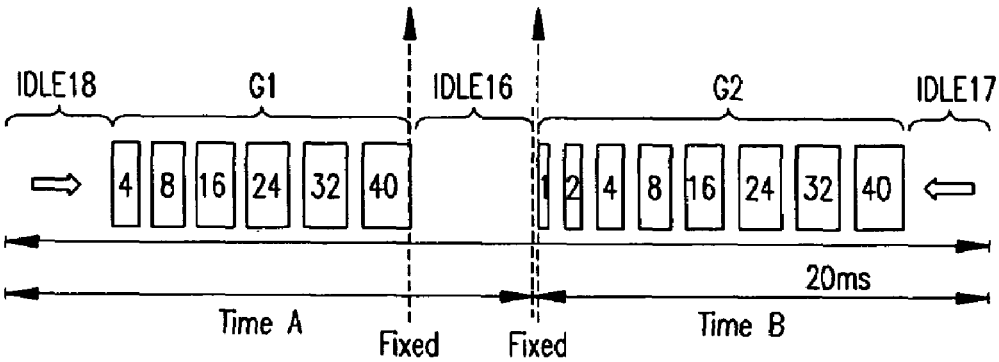
Figure 11C:
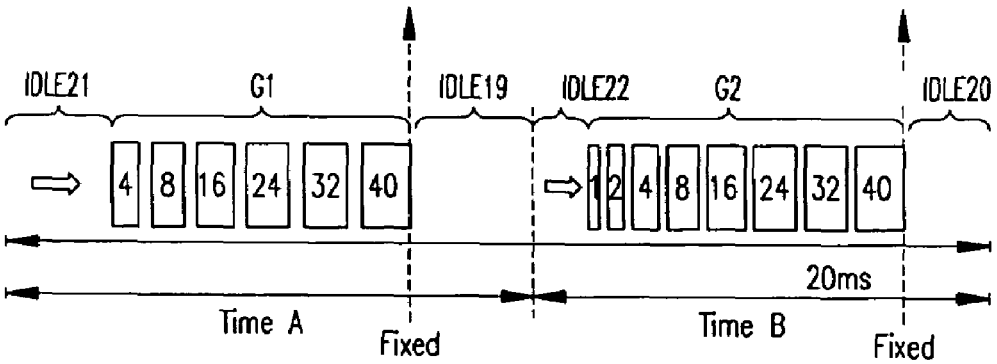

FIGS. 11*a* to 11*c* are diagrams respectively illustrating a sub-field arrangement according to a third embodiment of the present invention. FIG. 11*a* shows the case associated with a minimum APC level, FIG. 11*b* shows the case associated with an APC level increased from the minimum APC level, but not higher than a predetermined threshold value, and FIG. 11*c* shows the case associated with an APC level higher than the predetermined threshold value.

Figure 12A:
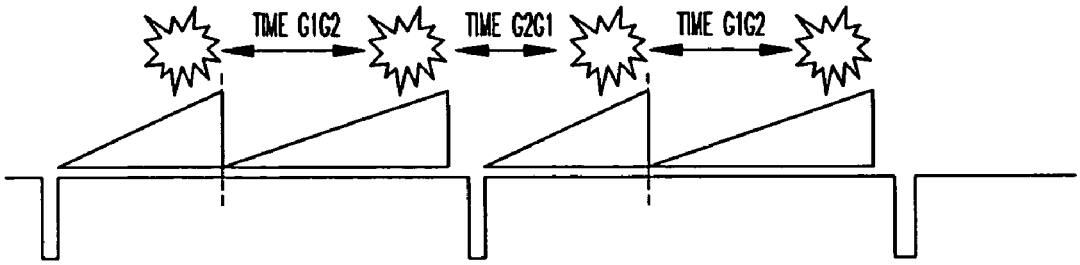
Figure 12B:
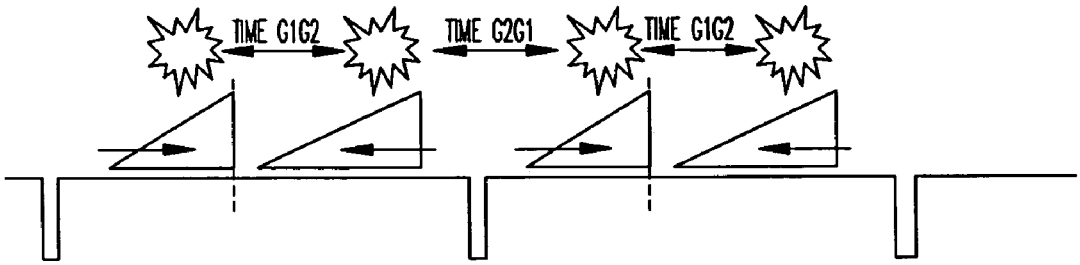
Figure 12C:
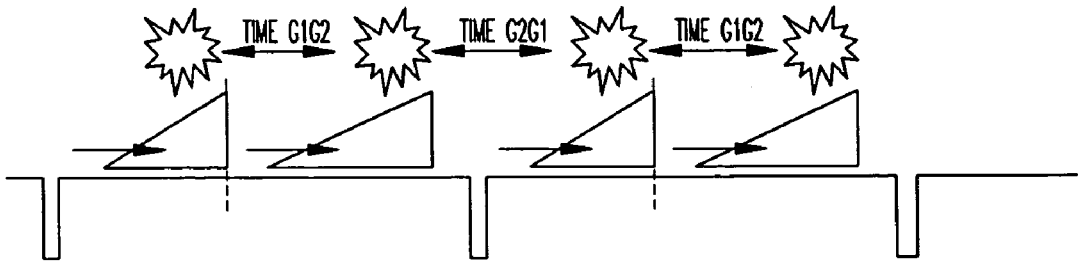

FIGS. 12*a* to 12*c* are diagrams showing sub-field positions and light emission center positions for various APC levels in the sub-field arrangement of FIGS. 11*a* to 11*c*. FIG. 12*a* shows the case associated with the minimum APC level, FIG. 12*b* shows the case associated with an APC level increased from the minimum APC level, but not higher than the predetermined threshold value, and FIG. 12*c* shows the case associated with an APC level higher than the predetermined threshold value.

Similarly to the above-described sub-field arrangement, the sub-field arrangement shown in FIGS. 11*a* to 11*c* has a low possibility of generation of pseudo contours in low gray scales because the sub-fields respectively having weights of 1 and 2 lower than those of the remaining sub-fields in the sub-field arrangement are arranged to be adjacent to each other. In this case, however, flickers may be generated because light emission centers are non-periodic, similarly to the above-described case. Such flicker generation can be reduced, using a method according to the third embodiment of the present invention.

In the case of the minimum APC level, as shown in FIG. 11*a*, there is no variation in idle periods IDLE13, IDLE14, and IDLE15. Accordingly, the light emission center positions of successive sub-field groups are non-periodic (that is, TIME G1G2>TIME G2G1, as shown in FIG. 12*a*).

When the APC level gradually increases from the minimum APC level, the end point of the first sub-field group G1 and the start point of the second sub-field group G2 are fixed. Accordingly, when the APC level gradually increases, the idle period IDLE18 positioned at the start point of the first sub-field group G1 gradually increases, as shown in FIG. 11*b*. In this case, the idle period IDLE17 positioned at the end point of the second sub-field group G2 also gradually increases. Accordingly, the time interval TIME G1G2 between the light emission center positions of the first and second sub-field groups G1 and G2 in one frame is gradually reduced, and the time interval TIME G2G1 between the light emission center position of the second sub-field group G2 in the frame and the light emission center position of the first sub-field group G1 in the next frame increases. Thus, the light emission center positions of successive sub-field groups gradually vary to have a periodicity (that is, TIME G1G2=TIME G2G1, as shown in FIG. 12*b*) as the APC level increases gradually. In this case, the increase of the idle periods IDLE17 and IDLE18 is stopped when the light emission center positions of successive sub-field groups have a periodicity. At this point, the APC level corresponds to the predetermined threshold value.

When the APC level increases over the predetermined threshold value, the end point of the first sub-field group G1 is fixed, as shown in FIG. 11*c*. Also, the end point of the second sub-field group G2 is fixed. Accordingly, the idle period IDLE21 positioned at the start point of the first sub-field group G1 is gradually increased in accordance with the increase in APC level. Also, the idle period IDLE 22 positioned at the start point of the second sub-field group G2 increases gradually. Through this method, the light emission center positions of successive sub-field groups G1 and G2 in successive frames (that is, the time intervals TIME G1G2 and TIME G2G1) have a periodicity from the point of time when the APC level corresponds to the predetermined threshold value. That is, when the APC level increases gradually, only the idle periods are gradually increased, and the light emission center positions of successive sub-field groups is maintained to have a periodicity (that is, TIME G1G2=TIME G2G1, as shown in FIG. 12*c*).

As is apparent from the above-described second and third embodiments of the present invention, the light emission center positions of successive sub-field groups in successive frames have a periodicity from the point of time when the APC level corresponds to the predetermined threshold value. Accordingly, it is possible to remarkably reduce generation of flickers. In this case, it is also possible to obtain the effect of reducing generation of pseudo contours because the sub-fields respectively having weights of 1 and 2 lower than those of the remaining sub-fields in the sub-field arrangement are arranged to be adjacent to each other.

Figure 13:
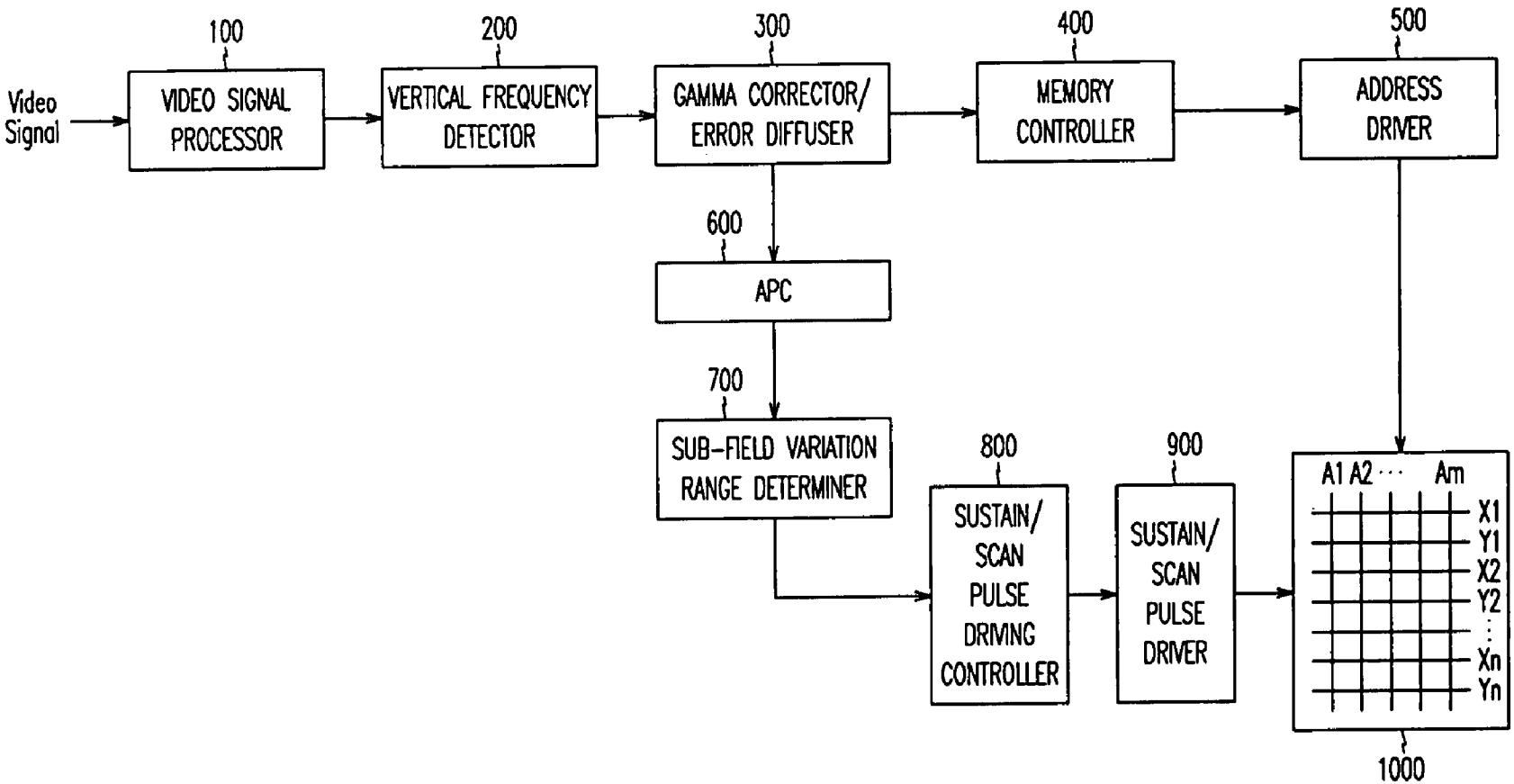
FIG. 13 is a block diagram illustrating an apparatus for displaying pictures on a PDP in accordance with an exemplary embodiment of the present invention.

FIG. 13 is a block diagram illustrating an apparatus for displaying pictures on a PDP in accordance with an exemplary embodiment of the present invention.

As shown in FIG. 13, the apparatus includes a video signal processor 100, a vertical frequency detector 200, a gamma corrector/error diffuser 300, a memory controller 400, an address driver 500, an APC 600, a sub-field variation range determiner 700, a sustain/scan pulse driving controller 800, a sustain/scan pulse driver 900 and a PDP 1000.

The video signal processor 100 digitizes a video signal externally inputted thereto, thereby generating digital video data.

The vertical frequency detector 200 analyzes the digital video data output from the video signal processor 100, and determines, based on the result of the analysis, whether the input video is data is an NTSC signal of 60 Hz or a PAL signal of 50 Hz. The vertical frequency detector 200 then outputs the result of the determination as a data switch value, together with the digital video data.

The gamma corrector/error diffuser 300 receives the digital video data output from the vertical frequency detector 200, and corrects the gamma value of the digital video data to meet the characteristics of the PDP 1000. Simultaneously, the gamma corrector/error diffuser 300 performs error diffusion to diffuse display errors of the digital video data to peripheral pixels. Thus, the gamma corrector/error diffuser 300 outputs the gamma-corrected and error-diffused digital video data. The data switch value, which represents whether the digital video data output from the vertical frequency detector 200 is an NTSC signal of 60 Hz or a PAL signal of 50 Hz, is output, as it is, to both the memory controller 400 and the APC 600 via the gamma corrector/error diffuser 300.

The memory controller 400 receives the digital video data and data switch value output from the gamma corrector/error diffuser 300, and generates sub-field data corresponding to the received digital image data, using a method selected in accordance with the data switch value from different methods respectively applied to a video signal of 50 Hz and a video signal of 60 Hz.

Where the data switch value represents a video signal of 60 Hz, the memory controller 400 generates sub-field data corresponding to the digital video data in such a manner that the sub-field data has a single sub-field group, as in conventional cases.

However, where the data switch value represents a video signal of 50 Hz, the memory controller 400 generates sub-field data in such a manner that the sub-field data is divided into two sub-field groups G1 and G2, the first sub-field group G1 consists of 8 sub-fields, and the second sub-field group G2 consists of 6 sub-fields, as shown in FIGS. 5 and 9*a*. The generated sub-field data is then output to the address driver 500 through memory input and output processing.

The address driver 500 generates address data corresponding to the sub-field data output from the memory controller 400, and applies the address data to respective address electrodes A1, A2, . . . , Am of the PDP 1000.

Meanwhile, the APC 600 detects a load ratio from the video data output from the gamma corrector/error diffuser 300, calculates an APC level, based on the detected load ratio, derives the number of sustain discharge pulses corresponding to the calculated APC level, and outputs the resultant values.

The sub-field variation range determiner 700 determines a variation range of each sub-field, based on the load ratio output from the APC 600, and determines a start position of each sub-field within the determined variation range of the sub-field. In this case, the sub-field variation range determiner 700 determines the start position of each sub-field, based on the load ratio (APC level), such that the start position of each sub-field corresponds to an associated one of the positions shown in FIG. 9*a*~9*c* or 11*a*~11*c*. That is, the sub-field variation range determiner 700 determines points, to be fixed, from start and end points of the first and second sub-field groups, based on whether or not the load ratio is higher than a predetermined threshold value, thereby determining a start position of each sub-field.

As the APC level is calculated from the detected load ratio in the gamma corrector/error diffuser 300, the APC level and the load ratio are convertible, and the threshold APC level can be converted into a threshold value of the load ratio. Therefore, the process of comparing the APC level with the threshold APC level can be replaced with a process of comparing the load ratio with a threshold value of the load ratio. A threshold value of the load ratio is defined as a load ratio of the input video signal, at which light emission center positions of the first and second sub-field groups are periodic.

The sustain/scan pulse driving controller 800 receives the number of sustain pulses, an address pulse width of each sub-field, the start position of each sub-field, and the data switch value, which are output from the sub-field variation range determiner 700. The sustain/scan pulse driving controller 800 then generates a sub-field arrangement, using a method selected in accordance with the data switch value from different methods respectively applied to a video signal of 50 Hz and a video signal of 60 Hz. The sustain/scan pulse driving controller 800 outputs the sub-field arrangement to the sustain/scan pulse driver 900.

The sustain/scan pulse driver 900 generates sustain pulses and scan pulses, based on the sub-field arrangement output from the sustain/scan pulse driving controller 800, and applies the sustain pulses and scan pulses to the sustain electrodes Y1, Y2, . . . , Yn and scan electrodes X1, X2, . . . , Xn, respectively.

As is apparent from the above description, in accordance with the present invention, it is possible to remarkably reduce generation of flickers by varying the idle periods of the first and second sub-field groups in each frame to periodically vary the light emission center positions of successive sub-field groups in successive frames.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for displaying pictures on a plasma display panel by dividing, into a plurality of sub-fields, each of frames respectively corresponding to pictures to be displayed on the plasma display panel, based on an input video signal, and combining luminance weights of the sub-fields to display gray scales, wherein the plurality of sub-fields are divided into a first sub-field group and a second sub-field group having sub-fields of a number less than a number of sub-fields in the first sub-field group, wherein the method comprises:

fixing a start point of the first sub-field group and an end point of the second sub-field group when the input video signal has a load ratio not higher than a predetermined threshold value, and applying sustain pulses of a number determined in accordance with the load ratio; and fixing an end point of the first sub-field group and the end point of the second sub-field group when the input video signal has a load ratio higher than the predetermined threshold value, and applying sustain pulses of the number determined in accordance with the load ratio.

2. The method of claim 1, wherein the first sub-field group includes sub-fields having luminance weights respectively corresponding to a least significant bit (LSB) and LSB+1 ones of the luminance weights of the plurality of sub-fields.

3. The method of claim 1, wherein idle periods respectively positioned at the end point of the first sub-field group and the start point of the second sub-field group vary depending on the load ratio of the input video signal when the load ratio of the input video signal is not higher than the predetermined threshold value.

4. The method of claim 1, wherein idle periods respectively positioned at the start point of the first sub-field group and the start point of the second sub-field group vary depending on the load ratio of the input video signal when the load ratio of the input video signal is higher than the predetermined threshold value.

5. The method of claim 4, wherein the idle periods increase in accordance with an increase in the load ratio of the input video signal.

6. The method of claim 4, wherein an idle period positioned at the end point of the second sub-field group does not vary.

7. The method of claim 4, wherein an idle period positioned at the end point of the first sub-field group is identical to an idle period positioned at the end point of the first sub-field group, which is set when the load ratio of the input video signal reaches the predetermined threshold value.

8. A method for displaying pictures on a plasma display panel by dividing, into a plurality of sub-fields, each of frames respectively corresponding to pictures to be displayed on the plasma display panel, based on an input video signal, and combining luminance weights of the sub-fields to display gray scales, wherein the plurality of sub-fields are divided into a first sub-field group and a second sub-field group having sub-fields of a number more than the number of sub-fields in the first sub-field group, wherein the method comprises:

fixing an end point of the first sub-field group and a start point of the second sub-field group when the input video signal has a load ratio not higher than a predetermined threshold value, and applying sustain pulses of a number determined in accordance with the load ratio; and fixing the end point of the first sub-field group and an end point of the second sub-field group when the input video signal has a load ratio higher than the predetermined threshold value, and applying sustain pulses of the number determined in accordance with the load ratio.

9. The method of claim 8, wherein idle periods respectively positioned at the start point of the first sub-field group and the start point of the second sub-field group vary depending on the load ratio of the input video signal when the load ratio of the input video signal is higher than the predetermined threshold value.

10. The method of claim 9, wherein an idle period positioned at the end point of the first sub-field group does not vary.

11. The method of claim 8, wherein idle periods respectively positioned at the start point of the first sub-field group and the end point of the second sub-field group vary depending on the load ratio of the input video signal when the load ratio of the input video signal is not higher than the predetermined threshold value.

12. An apparatus for displaying pictures on a plasma display panel by dividing, into a plurality of sub-fields, each of frames respectively corresponding to pictures to be displayed on the plasma display panel, based on an input video signal, and combining luminance weights of the sub-fields to display a gray scale, comprising:

a video signal processor digitizing the input video signal to generate digital video data;

a vertical frequency detector analyzing the digital video data output from the video signal processor, detecting, based on a result of the analysis, whether the input video data is a phase alternation line (PAL) signal, and outputting, together with the digital video data, the result of the determination as a data switch value;

a memory controller receiving the digital video data and data switch value output from the vertical frequency detector, generating sub-field data and address data corresponding to the received data switch value, and dividing the sub-field data into successive first and second sub-field groups when the input video signal is a PAL video signal, and applying the generated sub-field data and address data to the plasma display panel;

an automatic power controller detecting a load ratio of the digital video data to calculate an automatic power control (APC) level based on the detected load ratio, deriving a number of sustain discharge pulses corresponding to the calculated APC level, and outputting the calculated APC level the load ratio and the derived number of sustain discharge pulses;

a sub-field variation range determiner determining a variation range of each sub-field, based on the load ratio output from the automatic power controller, and determining points, to be fixed, from start and end points of the first and second sub-field groups, based on whether or not the load ratio is higher than a predetermined threshold value, thereby determining a start position of each sub-field; and a sustain/scan pulse driving controller receives the number of sustain pulses, an address pulse width of each sub-field, the start position of each sub-field and the data switch value from the sub-field variation range determiner to generate a sub-field arrangement based on the data switch value, to generate a control signal based on the generated sub-field arrangement, and to apply the control signal to the plasma display panel.

13. The apparatus of claim 12, wherein the number of sub-fields included in the first sub-field group is less than the number of sub-fields included in the second sub-field group.

14. The apparatus of claim 13, wherein the start point of the first sub-field group and the end point of the second sub-field group are fixed when the input video signal has a load ratio not higher than a predetermined threshold value, and the end point of the first sub-field group and the end point of the second sub-field group are fixed when the input video signal has a load ratio higher than the predetermined threshold value, to determine the start position of each sub-field.

15. The apparatus of claim 12, wherein the number of sub-fields included in the first sub-field group is more than the number of sub-fields included in the second sub-field group.

16. The apparatus of claim 12, wherein the start point of the first sub-field group and the end point of the second sub-field group are fixed when the input video signal has a load ratio not higher than a predetermined threshold value.

17. The apparatus of claim 12, wherein the end point of the first sub-field group and the end point of the second sub-field group are fixed when the input video signal has a load ratio higher than the predetermined threshold value, to determine the start position of each sub-field.

* * * * *